US008485010B1

(12) United States Patent
Francis

(10) Patent No.: US 8,485,010 B1
(45) Date of Patent: Jul. 16, 2013

(54) METHOD AND APPARATUS FOR INSTALLING A RETRACTABLE THERMOCOUPLE

(75) Inventor: Clayton A. Francis, Broken Arrow, OK (US)

(73) Assignee: Zeeco, Inc., Broken Arrow, OK (US)

( * ) Notice: Subject to any disclaimer, the term of this patent is extended or adjusted under 35 U.S.C. 154(b) by 407 days.

(21) Appl. No.: 12/960,613

(22) Filed: Dec. 6, 2010

(51) Int. Cl.
*B21C 51/00* (2006.01)
*F23G 7/08* (2006.01)

(52) U.S. Cl.
USPC ..... 72/31.03; 72/162; 431/202

(58) Field of Classification Search
USPC ..... 72/31.03, 79, 160, 162; 140/147; 431/59, 431/202, 349; 374/141, 179
See application file for complete search history.

(56) References Cited

U.S. PATENT DOCUMENTS

| | | | | |
|---|---|---|---|---|
| 3,672,655 | A | 6/1972 | Carter | |
| 3,798,948 | A * | 3/1974 | Fangmeier et al. | 72/162 |
| 3,929,511 | A | 12/1975 | Solomon | |
| 5,138,860 | A * | 8/1992 | Del Fabro et al. | 72/164 |
| 5,302,113 | A | 4/1994 | Eichelberger et al. | |
| 5,676,010 | A * | 10/1997 | College et al. | 72/162 |
| 5,816,466 | A | 10/1998 | Seufer | |
| 6,067,835 | A | 5/2000 | Pollock | |
| 6,536,950 | B1 | 3/2003 | Green et al. | |
| 7,383,973 | B2 | 6/2008 | Enyedy | |
| 7,441,682 | B2 | 10/2008 | Kerekes et al. | |
| 2004/0050131 | A1 * | 3/2004 | Militaru et al. | 72/162 |
| 2007/0266634 | A1 | 11/2007 | Tsangaris et al. | |
| 2007/0289216 | A1 | 12/2007 | Tsangaris et al. | |
| 2008/0199554 | A1 | 8/2008 | Manda et al. | |

FOREIGN PATENT DOCUMENTS

| | | | |
|---|---|---|---|
| JP | 2001030077 | A | 2/2001 |
| JP | 2001205335 | | 7/2001 |
| JP | 2003266149 | A | 9/2003 |
| JP | 2008110359 | A | 5/2008 |
| WO | WO 9850191 | | 11/1998 |

OTHER PUBLICATIONS

Unknown, Advanced Rupture Disk Technology, Inc. "Gas Pilots", Apr. 20, 2010, Publisher: Printout from the Internet, Published in: US.
Bellovich, et al, "Flare Pilot System Safety", Mar. 2007, pp. 10-14, vol. 26, No. 1, Publisher: American Institute of Chemical Engineers, 2006 Spring National Meeting, Orlando, FL, Published in: US.
John Zink.Com, "Pilot Monitoring Systems", Apr. 20, 2010, Publisher: Internet Printout, Published in: US.
John Zink.Com, "Retractable Systems", Apr. 20, 2010, Publisher: Internet Printout, Published in: US.
John Zink.Com, "Retractable Thermocouples", Apr. 20, 2010, Publisher: Internet Printout, Published in: US.
ZEECO, Inc., "Auxiliary Equipment Pilot Monitors", Apr. 20, 2010, Publisher: Printout From the Internet, Published in: US.

* cited by examiner

*Primary Examiner* — Edward Tolan
(74) *Attorney, Agent, or Firm* — Dennis D. Brown; Brown Patent Law, P.L.L.C.

(57) ABSTRACT

A method and apparatus for installing a retractable thermocouple at the upper end of a flare stack for sensing a flare pilot burner flame. The apparatus comprises: a portable mounting structure; two pair of opposing drive wheels having non-metallic contacting surfaces; a first set of offset straightening rollers having non-metallic contacting surfaces for straightening the thermocouple in a first plane; and a second set of offset straightening rollers having non-metallic contacting surfaces for straightening the retractable thermocouple in a second plane different from the first plane.

18 Claims, 8 Drawing Sheets

METHOD AND APPARATUS FOR INSTALLING A RETRACTABLE THERMOCOUPLE

FIELD OF THE INVENTION

The present invention relates to methods and apparatuses for removably installing retractable thermocouples in flare pilot burners for sensing a pilot burner flame.

BACKGROUND OF THE INVENTION

Flare systems are used in petroleum refineries and chemical processing plants for burning flammable, explosive, and/or hazardous materials which are vented from processing systems and equipment as a result of overpressure or other upset conditions. Vertical flare stacks used in refineries and chemical plants can be as much as 500 feet or more in height. The materials vented to the flare system are discharged from the upper end of the flare stack where they are immediately ignited by one or more continuously burning flare pilots.

In order to ensure that the dangerous gases discharged from the top of the flare stack are ignited and burned, flare pilot monitors are commonly used for automatically sensing the presence of the pilot flame and notifying the operator in the event that the pilot flame has gone out. The monitoring system will also typically be linked to a controller and relighting device which will automatically relight the flare pilot flame in the event that an outage occurs.

Flare pilot monitoring systems typically employ thermocouple temperature sensors positioned within the pilot burner at the top of the flare stack. Unfortunately, due to the extreme temperature conditions and temperature swings experienced during operation at the top of the flare stack, the thermocouples tend to have a relatively short service life and must be frequently replaced.

To avoid the necessity of shutting down the flare system, and potentially the entire refinery or chemical plant, when removing and replacing a flare pilot sensor, retractable thermocouples are used which can be installed at grade. Consequently, these retractable thermocouples can be installed or replaced while the flare stack remains in operation.

The retractable thermocouple will typically be unwound from a spool and pushed through a stainless steel conduit extending up the vertical flare stack. The retractable thermocouple must be pushed through the thermocouple tubing until a sensing tip on the end of the thermocouple is seated within a thermowell inside the flare pilot burner. The thermocouple tubing is preferably routed up the flare stack with long radius bends which assist in allowing the retractable thermocouple to be pushed as freely as possible through the lengthy vertical tubing to the top of the flare stack.

Unfortunately, however, the frictional and gravitational forces experienced while pushing the retractable thermocouple up the lengthy vertical tubing can make the delivery of the retractable thermocouple to the top of the flare stack extremely difficult and can oftentimes prevent the sensor tip from being fully delivered into the flare pilot thermowell. Moreover, the frictional forces encountered when attempting to push the retractable thermocouple to the top of the flare stack through the thermocouple tubing can be severely exacerbated due to kinks, bends, or other irregularities which are inherently produced when coiling and uncoiling the retractable thermocouple, or are otherwise formed in the thermocouple during production, shipping, storage, and use.

The devices developed heretofore for attempting to remove kinks, bends, and other irregularities from retractable thermocouples have had significant shortcomings and disadvantages. These prior art devices have typically consisted of an offset cyclic straightener which will displace the thermocouple slightly from its center axis so as to slightly cold-work the thermocouple sheath. The offset spins around the thermocouple axis so as to cold-work the thermocouple in a direction which will hopefully erase any previous "memory" of the sheath and thus straighten the thermocouple.

The use of these prior straightening devices has been inadequate and problematic because the devices are susceptible to damaging and breaking the thermocouple and the devices add frictional resistance to the thermocouple insertion process. The devices also require that the thermocouple be moved continuously through the straightener. Otherwise, the cyclic bending will fatigue the thermocouple sheath and damage or break it, thus rendering the thermocouple inoperable. Also, if the pushing force applied is inconsistent or insufficient, the operation of the device must be interrupted. Further, the prior devices require that the thermocouple pass through and contact several ferrules which add significant amounts of sliding friction to the already problematic resistance which must be overcome during installation.

In addition to straightening, a need exists for an improved apparatus for pushing the retractable thermocouple through the thermocouple tubing to the top of the flare stack. Heretofore, retractable thermocouples have either been manually pushed to the top of the flare stack by hand or have been pushed through the thermocouple tubing using driven metal wheels. The metal wheels have a tendency to slip due to low contact friction and, in doing so, the metal wheels may damage the thermocouple sheath.

The use of the prior thermocouple pushing device has also been inadequate and problematic because the attempted straightening and pushing functions have been conducted by separate devices. The prior art straightening method requires significant pushing force for just the straightening process alone. However, even without the additional resistance imported by the straightener, the pusher is often still incapable of pushing the thermocouple to its complete length.

SUMMARY OF THE INVENTION

The present invention provides a method and apparatus for installing a retractable thermocouple which satisfy the needs and alleviate the problems discussed above.

In one aspect, there is provided a method of installing a retractable thermocouple for sensing a flame of a flare pilot at an upper end of a flare stack. The method preferably comprises the steps of: (a) pushing the retractable thermocouple through a first set of offset straightening rollers to straighten the retractable thermocouple in a first plane; then (b) pushing the retractable thermocouple through a second set of offset straightening rollers to straighten the retractable thermocouple in a second plane different from the first plane; and then (c) pushing the retractable thermocouple through a conduit which extends upwardly toward the flare pilot at the upper end of the flare stack. Each of the straightening rollers in the first set and the second set of offset straightening rollers preferably has a non-metallic contacting surface which contacts the retractable thermocouple.

In addition, the retractable thermocouple is preferably pushed through the first set of offset straightening rollers in accordance with step (a), the second set of offset straightening rollers in accordance with step (b), and the conduit in accordance with step (c) using a set of drive wheels having non-metallic contacting surfaces which contact the retractable thermocouple.

In another aspect, there is provided an apparatus for pushing and straightening a retractable thermocouple comprising: (a) a portable mounting structure; (b) two pair of opposing non-metallic drive wheels secured on the portable mounting structure for receiving the retractable thermocouple and pushing the retractable thermocouple in a direction of travel; (c) a first set of offset, non-metallic straightening rollers secured on the portable mounting structure downstream of the two pair of opposing non-metallic drive wheels in the direction of travel for receiving the retractable thermocouple to straighten the retractable thermocouple in a first plane; and (d) a second set of offset, non-metallic straightening rollers secured on the portable mounting structure downstream of the first set of offset, non-metallic straightening rollers in the direction of travel for receiving the retractable to thermocouple to straighten the retractable thermocouple in a second plane which is substantially perpendicular to the first plane.

Further aspects, features, and advantages of the present invention will be apparent to those of ordinary skill in the art upon examining the accompanying drawings and upon reading the following detailed description of the preferred embodiments.

BRIEF DESCRIPTION OF THE DRAWINGS

FIG. 1 does not show the apparatus cover assembly 115.

FIG. 2 does not show the apparatus cover assembly 115.

FIG. 3 does not show the apparatus cover assembly 115.

DETAILED DESCRIPTION OF THE PREFERRED EMBODIMENTS

Figure 1:
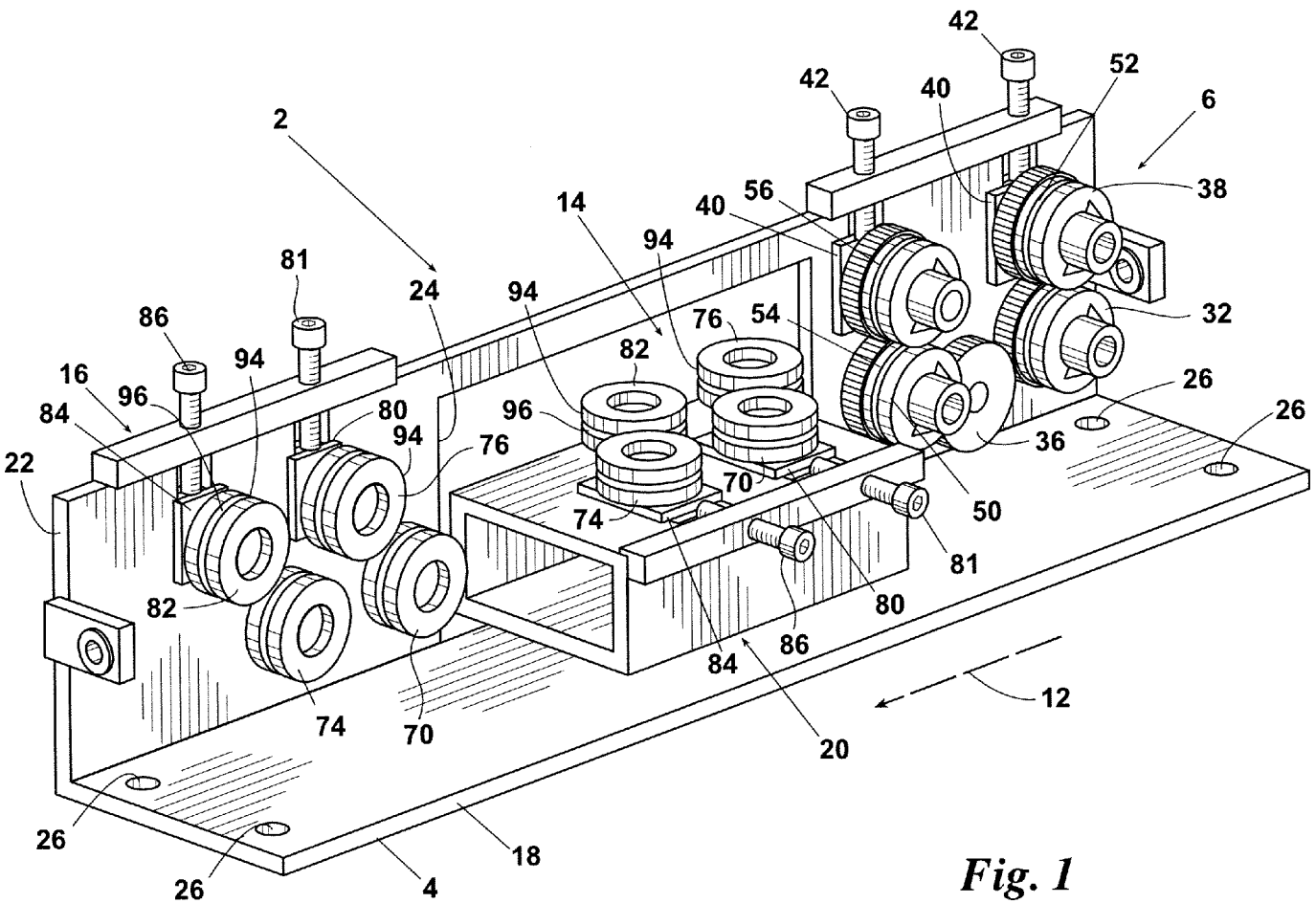
FIG. 1 is a perspective view of an embodiment 2 of the inventive thermocouple pushing and straightening device provided by the present invention.
Figure 2:
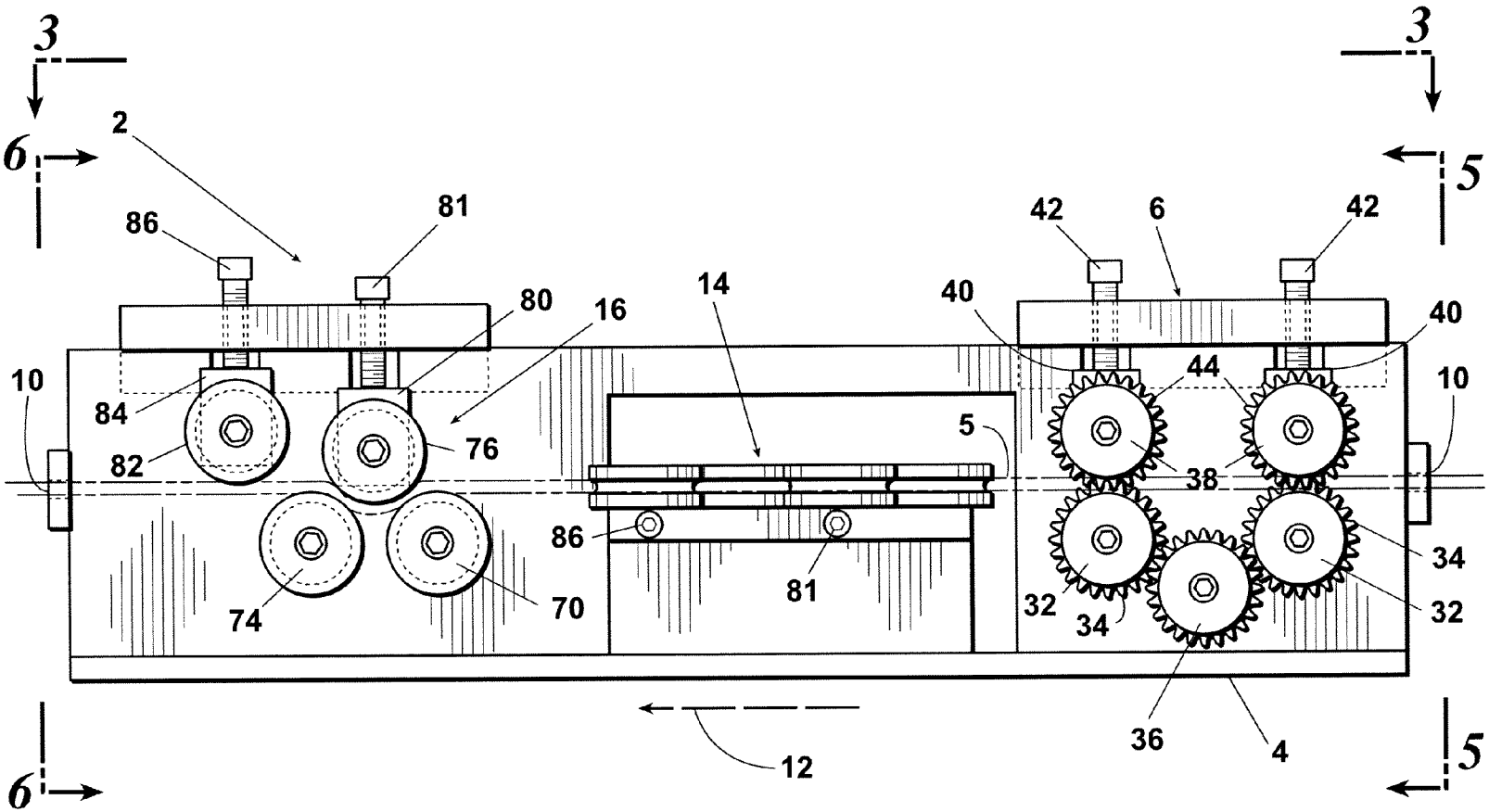
FIG. 2 is an elevational front view of the inventive pushing and straightening device 2.
Figure 3:
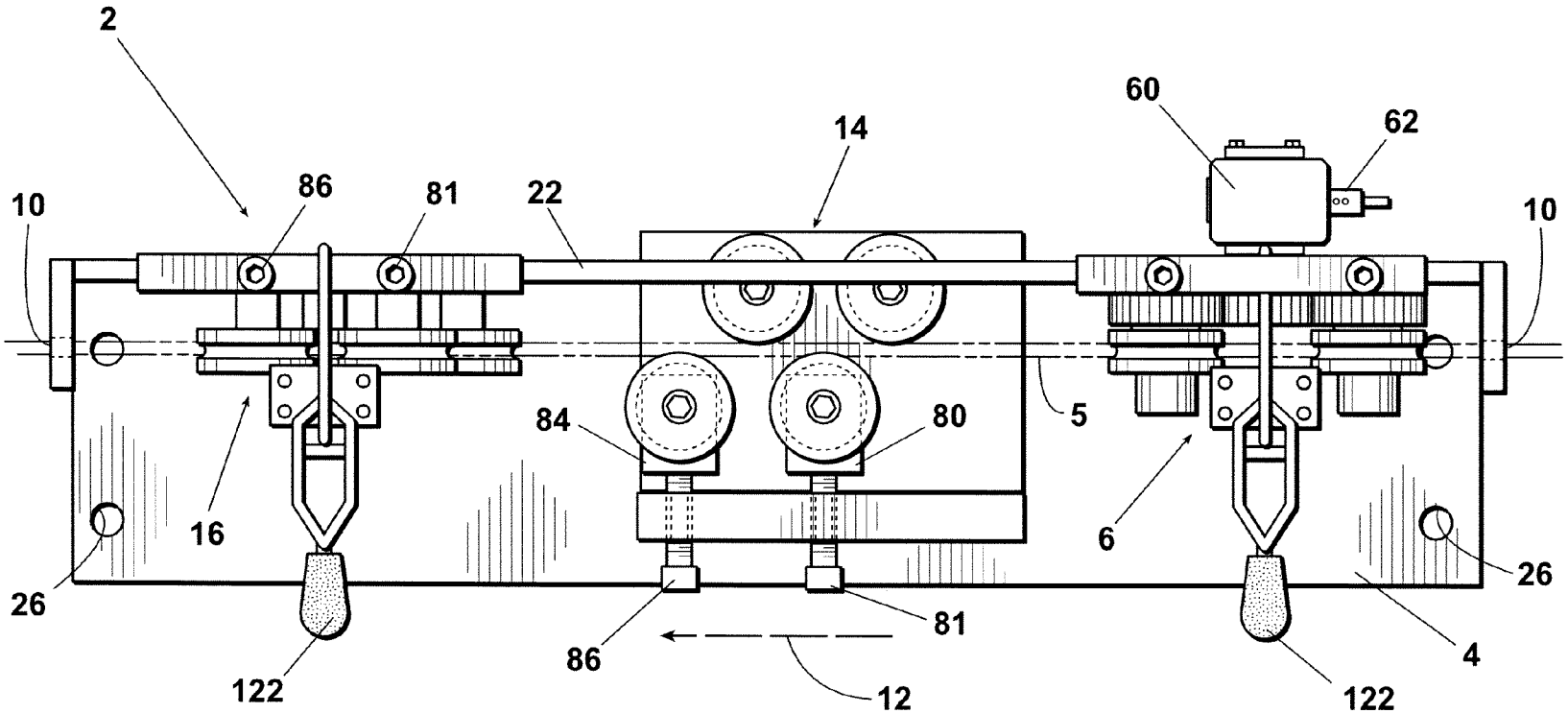
FIG. 3 is a plan view of the inventive pushing and straightening device 2.
Figure 4:
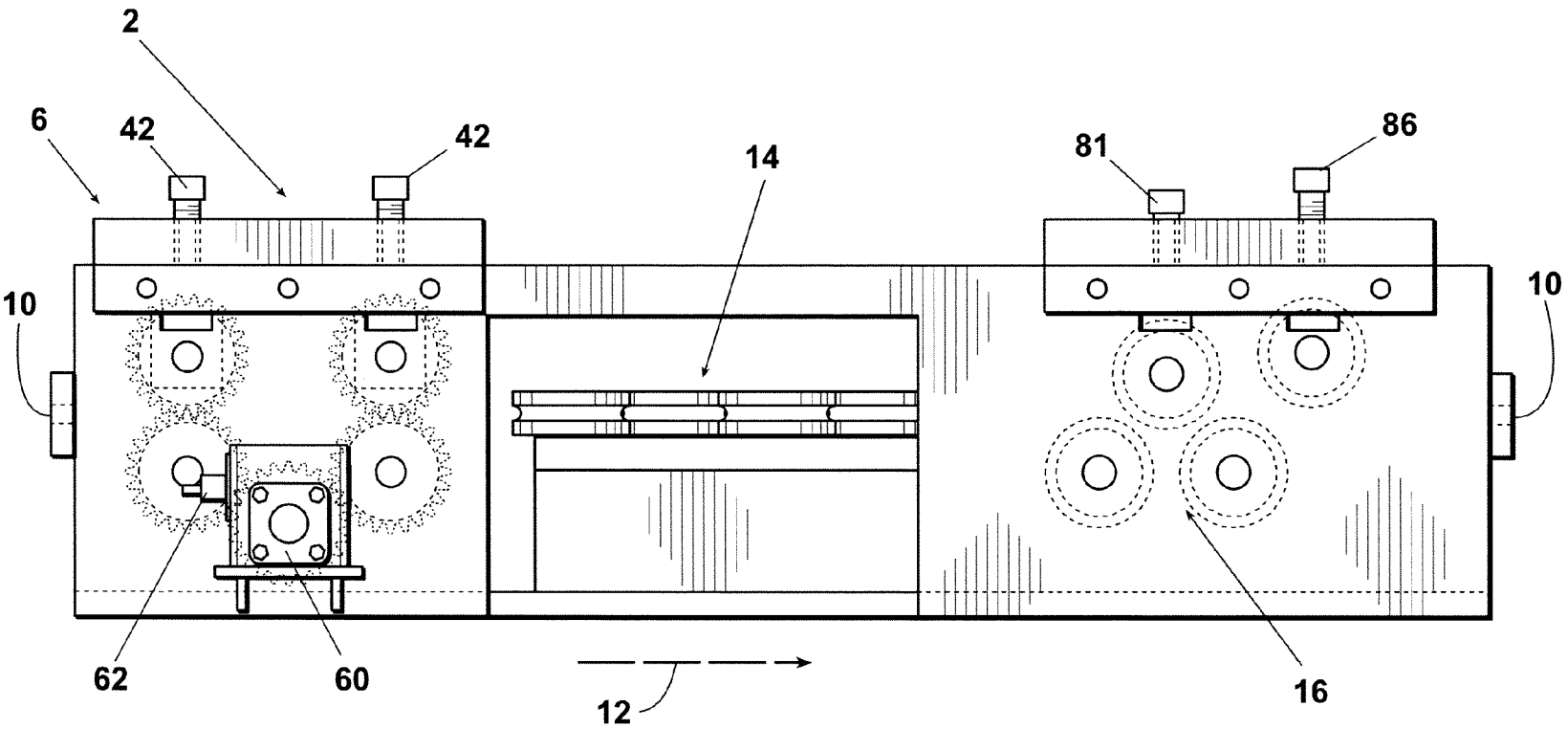
FIG. 4 is an elevational back view of the inventive pushing and straightening device 2.
Figure 5:
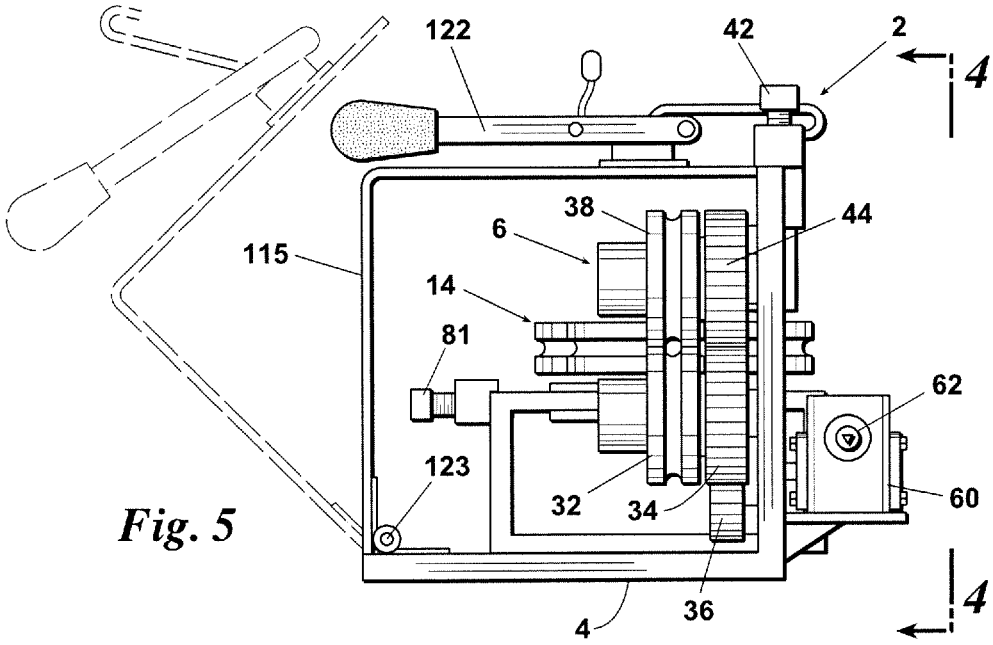
FIG. 5 is an elevational inlet end view of the inventive pushing and straightening device 2.
Figure 6:
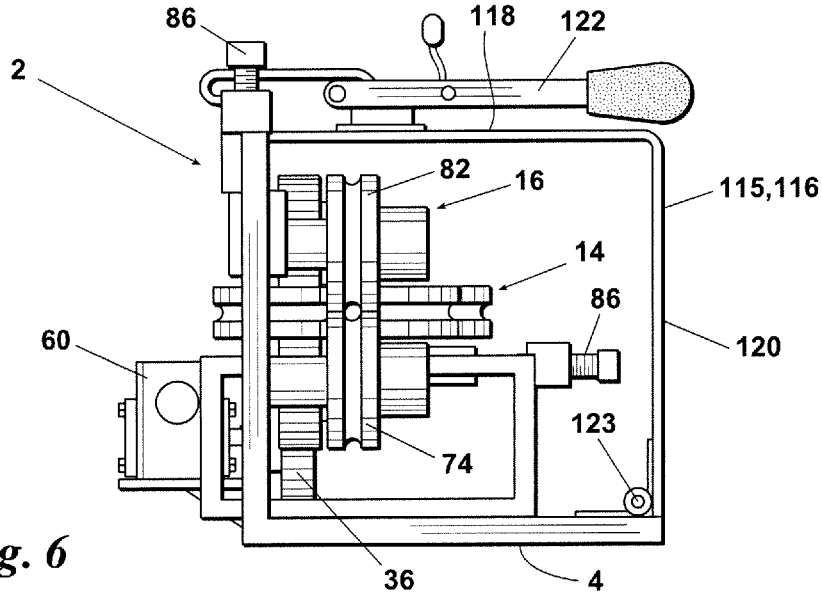
FIG. 6 is an elevational outlet end view of the inventive pushing and straightening device 2.
Figure 7:
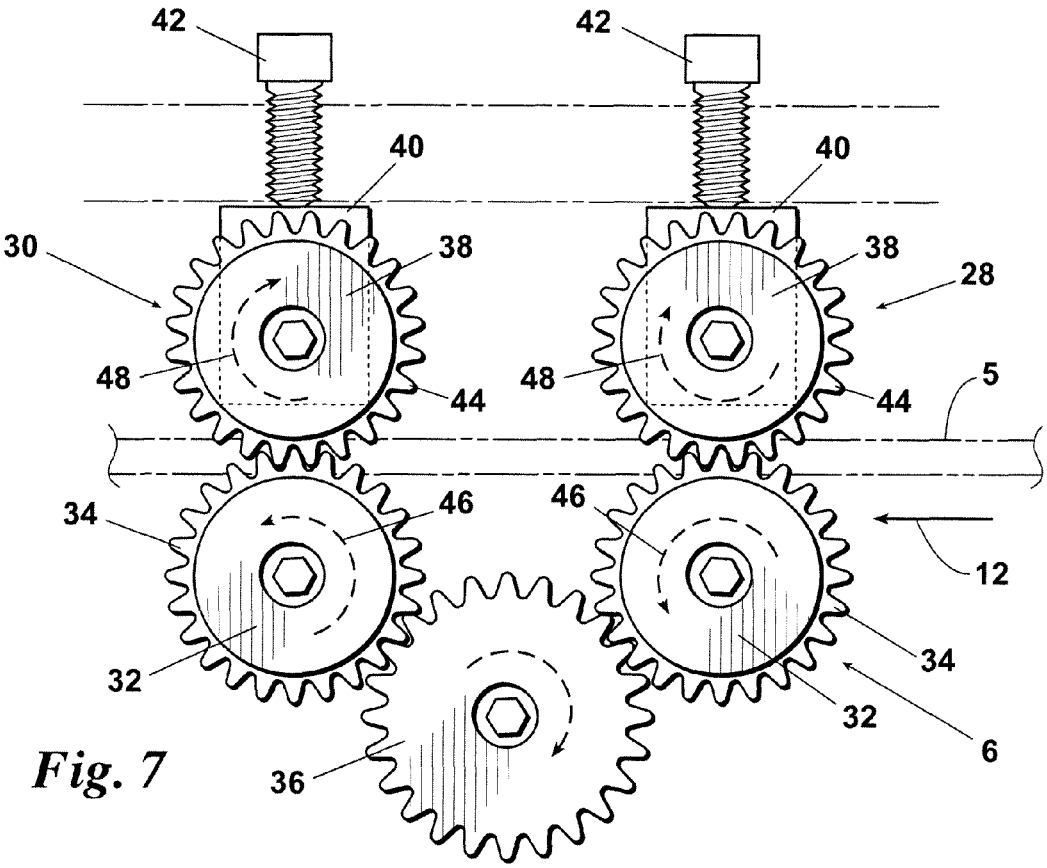
FIG. 7 schematically illustrates a drive wheel assembly 8 of the inventive pushing and straightening device 2.

An embodiment 2 of an inventive portable pushing and straightening device 2 provided by the present invention is illustrated in FIGS. 1-14. The inventive pushing and straightening device 2 preferably comprises: a portable mounting support 4; a drive wheel assembly 6 operably secured on the support 4; a gearbox assembly 60 for powering (i.e., turning) the set of drive wheels 6; a thermocouple inlet guide 10 positioned upstream of the drive wheel arrangement 6 for guiding a retractable thermocouple 5 into the drive wheel assembly 6 in a direction of travel 12; a first set of offset straightening rollers 14 secured on the portable mount 4 downstream of the drive wheel arrangement 6 for straightening the thermocouple in a first plane (e.g., a horizontal plane); and a second set of straightening rollers 16 secured on the mount 4 downstream of the first set of rollers 14 for straightening the thermocouple in a second plane different from the first plane (e.g., a vertical plane substantially perpendicular to the horizontal plane).

As used herein and in the claims, descriptions of components or features of the inventive portable pushing and straightening device 2 as being "horizontal" or in a "horizontal plane" refer to the orientation of such components and features when the inventive device 2 is installed on a horizontal table or other horizontal platform.

The portable mounting structure 4 can be generally any type of portable frame, housing, platform, or other structure on which the driving and straightening components can be secured in operable order. The portable mounting structure 4 preferably comprises: a horizontal base 18 on which a raised platform 20 for the first set of straightening rollers 14 is mounted; a vertical back wall 22 on which the drive wheel assembly 6 and the second set of straightening rollers 16 are respectively mounted before and after, and in operating alignment with, the first set of straightening rollers 14; an opening 24 through the vertical back wall 22 into which some of the first set of straightening rollers 14 extend to accommodate the alignment of the first set of straightening rollers 14 with the drive wheel assembly 6 and with the second set of straightening rollers 16; and a plurality of (preferably at least four) holes 26 provided in the base 18 for removably mounting the inventive pushing and straightening device 2 for installing a retractable thermocouple 5 in, and/or removing a retractable thermocouple from, a flare pilot burner 110 located at the upper end of a flare stack 100.

The inventive pushing and straightening device 2 can, for example, be removably mounted either (a) vertically on brackets provided substantially at grade (i.e., at a convenient operating height preferably less than 10 feet above ground level) at the bottom of the flare stack 100, (b) on a platform located substantially at grade (i.e., at a convenient operating height preferably less than 10 feet above ground level) near the base of the flare stack 100, or (c) on a platform located any desired distance from the base of the flare stack outside of a radiation fence or outside of any other type of fence or protective enclosure.

The drive wheel assembly 6 of the inventive device 2 includes a set of drive wheels which preferably comprise a first pair 28 and a second pair 30 of opposing drive wheels. Each pair 28 and 30 of opposing drive wheels comprises (a) a first wheel 32 which is rotatably secured in fixed position on the vertical back wall 22 of the mounting support 4 and has a gear 34 secured on the base thereof which engages a main drive gear 36 and (b) an opposing second wheel 38 which is rotatably mounted on a sliding block 40 which is slidably retained in the mount back wall 22 for reciprocating adjustment toward and away from the first wheel 32 using an adjustment screw 42. Each adjustable wheel 38 also has a gear 44 secured to the base thereof such that, when the adjustable wheels 38 are moved toward the set wheels 32 for engaging the thermocouple 5 and pushing the thermocouple 5 through the inventive device 2, the gears 44 of the adjustable drive wheels 38 engage the gears 34 of the set drive wheels 32 so that all of the drive wheels 32 and 38 are driven by the main drive gear 36 in the rotational directions 46 and 48 shown in FIG. 7 for applying a shear force to the thermocouple 5.

Each component of the inventive pushing and straightening device 2 is preferably adapted to accommodate the size and cross-sectional shape of the retractable thermocouple 5 and to accomplish the difficult task of pushing and straightening the retractable thermocouple 5 without harming the exterior metal sheath which extends the length of the thermocouple 5. Thus, in one particularly unique aspect, all of the components of the inventive device 2 which operate to guide, drive, and straighten the thermocouple 5 will preferably be constructed or formed such that no metal-to-metal contact with the thermocouple 5 occurs as the thermocouple 5 travels through the inventive pushing and straightening device 2.

Consequently, each driving wheel 32 and 38 is preferably formed such that (a) the outer contacting surface 50 or 52 of each wheel is a non-metallic contacting surface and (b) opposing grooves 54 and 56 corresponding to the cross-sectional size and shape of the sheath of the thermocouple 5 are formed in the outer contacting surfaces 50 and 52 for receiving and gripping the thermocouple 5 between each pair 28 and 30 of opposing drive wheels 32 and 38. As a result, the integrity of the thermocouple sheath is preserved while imparting sufficient shear force to push the thermocouple 5 through the inventive device 2 and through the vertical thermocouple guide tube 102 extending to the top of the flare stack 100.

Each drive wheel 32 and 38 is preferably formed of a durable polymer, preferably urethane and most preferably cast 93A urethane. Cast 93A urethane provides a particularly effective coefficient of friction for pushing the thermocouple 5 while also providing desirable durability and sufficient elasticity for protecting the thermocouple sheath.

Similarly, the thermocouple inlet and outlet guides 10 are preferably a non-metallic guide formed of a durable polymer, such as Teflon® or urethane, and are most preferably formed of 95A urethane.

The drive wheel powering assembly which powers the two pair 28 and 30 of drive wheels 32 and 38 preferably comprises: (a) a gearbox 60 which is positioned outside of the back wall 22 of the mounting structure 4 and which has an output driveshaft 58 for engaging the main drive gear 36 of the inventive device 2 and (b) a chuck adaptor 62 which is connectable to the input 63 of the gearbox 60 for operating the drive wheel powering assembly preferably using an electric or pneumatic drill or other power tool.

By allowing the use of a simple hand drill or similar tool for driving the inventive pushing and straightening device 2, the inventive device 2 can be employed in any hazardous area, regardless of classification, without any alteration to the equipment. A chuck adaptor 62 for a typical hand drill will comprise: a female end portion 64 which slides over the input shaft 63 of the gearbox 60; a male end portion 66 having machined flats adapted for gripping receipt in a hand drill chuck; and threaded radial bores 68 which will align with a keyway on the input shaft of the gearbox 60 whereby set screws are received in the threaded bores 68 and tightened to secure the adaptor 62 to the input shaft.

Figure 8:
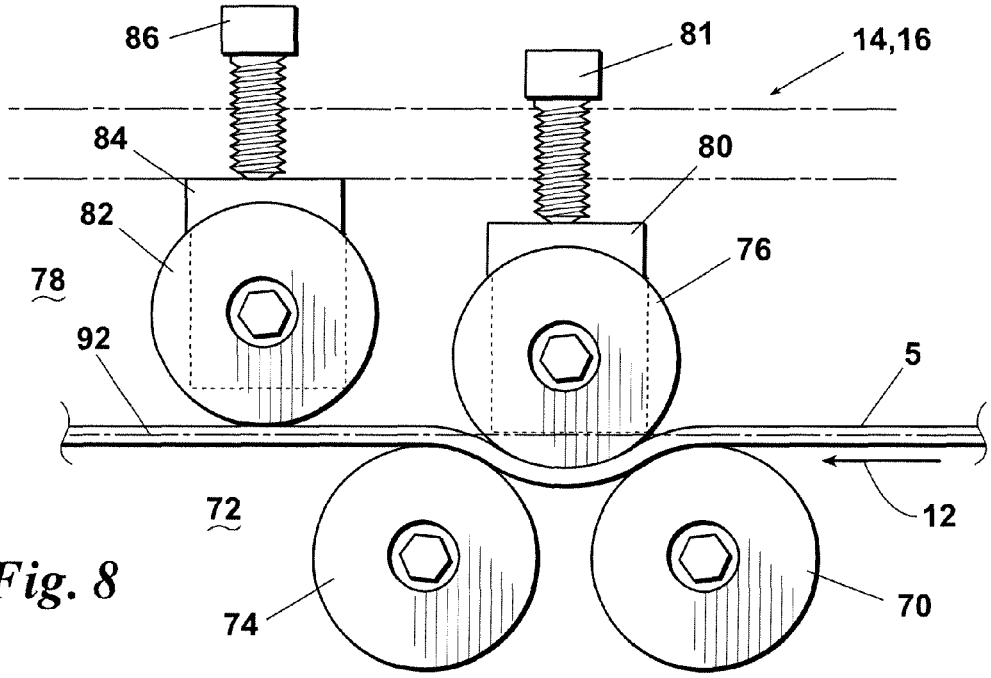
FIG. 8 schematically illustrates a set 14 or 16 of offset straightening rollers used in the inventive pushing and straightening device 2.
Figure 9:
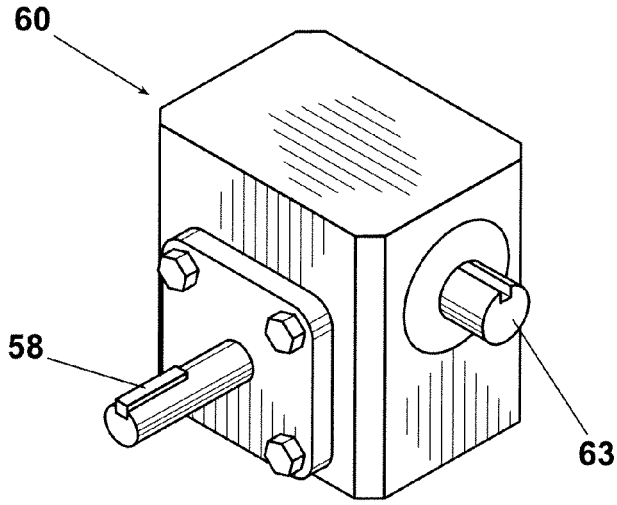
FIG. 9 is a perspective view of a gearbox assembly 60 for driving the inventive pushing and straightening device 2.
Figure 10:
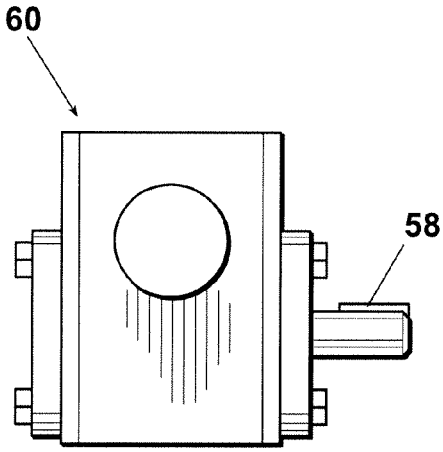
FIG. 10 is an elevational end view of the gearbox assembly 60.
Figure 11:
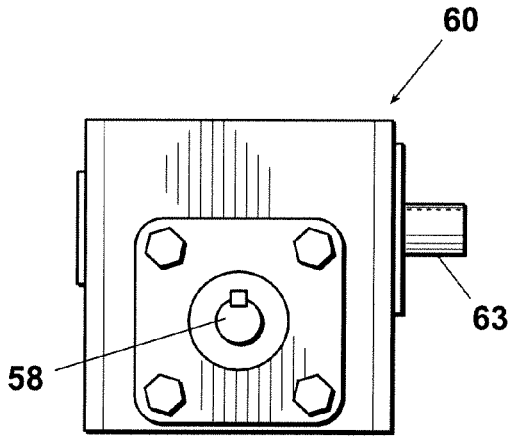
FIG. 11 is an elevational side view of the gearbox assembly 60.
Figure 12:
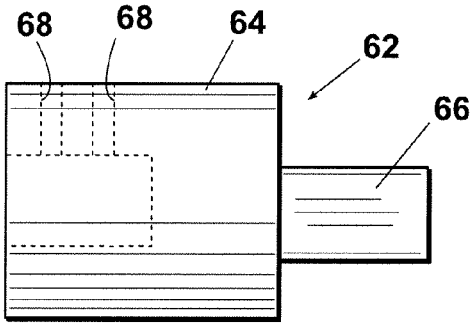
FIG. 12 is an elevational side view of a chuck adaptor 62 for driving the inventive pushing and straightening device 2 using a power tool.
Figure 13:
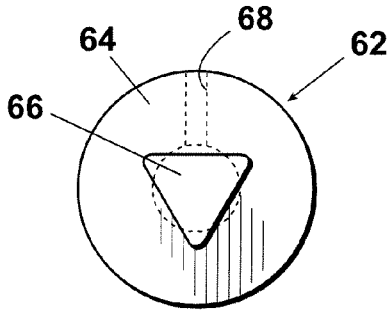
FIG. 13 is an elevational end view of the chuck adaptor 62.

The two sets 14 and 16 of offset straightening rollers are preferably identical except that they are oriented to straighten (e.g., remove kinks, bends, and/or other irregularities) from the retractable thermocouple 45 in two different, and most preferably perpendicular, planes. As illustrated in FIG. 8, each set 14 and 16 of offset straightening rollers preferably comprises: a first idler roller 70 which is rotatably secured on the mounting structure 4 in set position on a first lateral side 72 of the thermocouple 5; a second idler roller 74 spaced forwardly from the first idler roller 70 on the same lateral side 72 of the thermocouple 5; an adjustable deflecting roller 76 rotatably installed on the opposite lateral side 78 of the thermocouple 5 such that the adjustable deflecting roller 76 is offset between the first and second idler rollers 70 and 74 with regard to the direction of travel 12 of the thermocouple 5; a sliding block 80 slideably retained in the mounting structure 4 for adjustably moving the deflecting roller 76 and setting the roller 76 in a desired position toward or away from of the thermocouple 5 using an adjustment screw 81; and a similarly adjustable exit angle roller assembly on the lateral side 78 of thermocouple 5 downstream of the second idler roller 74. The exit angle roller assembly comprises: an adjustable exit angle roller 82, a sliding block 84, and a sliding block adjustment screw 86 for adjustably moving the exit angle roller 82 toward and away from the retractable thermocouple 5 to contact the thermocouple 5 and deflect the thermocouple 5 toward the first lateral side 72 at a desired exit angle.

The adjustable deflecting roller 76 of each set 14 and 16 of offset straightening rollers is preferably set in position during operation so as to deflect the thermocouple 5 (i.e., to cause the thermocouple 5 to bend around the lower leading contact portion of the deflecting roller 76) as the thermocouple 5 travels from the first idler roller 70 to the second idler roller 74. This bending motion cold-works the thermocouple 5 on side 72 in the bending plane in question to effectively reset the memory of the metal sheath material. Similarly, the exit angle roller 82 cold-works thermocouple 5 on the opposite lateral side 78 in the bending plane and also sets the exit trajectory of the thermocouple 5 from the roller set 14 or 16.

The adjustable deflecting roller 76 is preferably set to contact the thermocouple 5 such that the centerline 92 of the thermocouple 5 is deflected by the adjustable deflecting roller 76 toward the first lateral side 72 by an amount in the range of from about ⅛ to about ¾ inch. The adjustable deflecting roller 76 more preferably deflects the centerline 92 of the thermocouple 5 by an amount in the range of from about ¼ to about ½ inch and most preferably deflects the centerline 92 of the thermocouple 5 by an amount of about ⅜ inch.

For the same reasons discussed above concerning the drive wheels 32 and 38, each straightening roller 70, 74, 76, and 82 used in the inventive device 2 preferably has a non-metallic outer contacting surface 94 with a receiving groove 96 formed therein which has a size and shape corresponding to the cross-sectional size and shape of the thermocouple 5. Each straightening roller 70, 74, 76, and 82 is preferably formed of a durable polymer such as urethane and is most preferably formed of cast 95A urethane. In addition, each straightening roller 70, 74, 76, and 82 is preferably rotatably mounted in the inventive device 2 using a ball bearing attachment (not shown) in order to minimize frictional resistance resulting from the rotation of the straightening rollers 70, 74, 76, and 82 during the straightening process.

Figure 14:
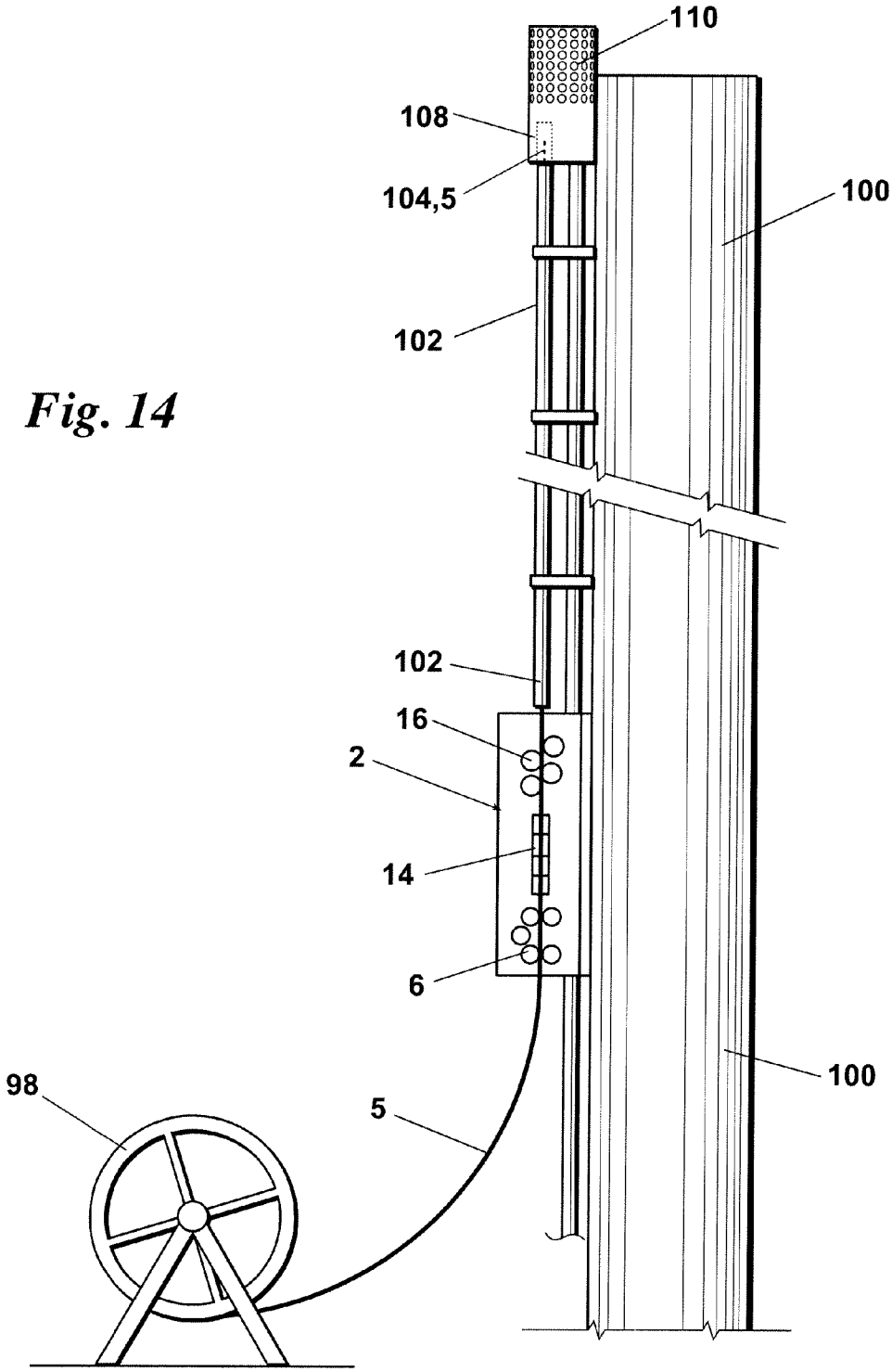
FIG. 14 schematically illustrates the use of the inventive pushing and straightening device 2 for installing a retractable thermocouple 5.

The use of the inventive pushing and straightening device 2 for installing a retractable thermocouple 5 in a pilot burner thermowell 108 at the top of a flare stack 100 is illustrated in FIG. 14. The coiled thermocouple 5 is delivered from a spool 98 to the inventive pushing and straightening device 2 which is temporarily attached in vertical position to the base of the flare stack 100, preferably at from about 2 to about 8 feet above grade. The drive wheel assembly 6 of the inventive apparatus 2 pushes the thermocouple 5 through the first set of offset straightening rollers 14 which straighten the thermocouple 5 in a first plane and then through the second set of offset straightening rollers 16 which straighten the thermocouple in a second plane different from (most preferably perpendicular to) the first plane. The inventive pushing and straightening device 2 also sets the trajectory of the straightened thermocouple 5 as it exists the inventive device 2 such that the straightened thermocouple 5 is delivered into the vertical thermocouple guide tube 102 and is pushed through the guide tube 102 to the top of the flare stack 100 until the sensing end 104 of the thermocouple 5 is received in the thermowell 108 of the pilot burner 110.

The inventive portable pushing and straightening device 2 can then be removed from the flare stack 100 and used for installing or removing other thermocouples, or simply stored for later use.

When using the inventive portable device 2 for removing a retractable thermocouple 5, the installation process is essentially reversed except that only the drive wheel assembly 6 of the inventive device 2 will be needed for the removal operation. Typically, when removing a retractable thermocouple 5, neither set 14 nor 16 of offset straightening rollers will be set in operable straightening engagement with the thermocouple 5.

The inventive portable device 2 also preferably includes a cover assembly 115 for protecting all of the various drive wheels and straightening roller assemblies during storage, transport, and use. The cover assembly 115 comprises: a cover 116 having a horizontal top wall 118 and a vertical front wall 120; hinges 123 which pivotably connect the cover 116 to the mounting structure base 18 for opening and closing the cover 116; and one or more (preferably 2) latch assemblies 122 for releasably locking the cover 116 in closed position.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the invention as defined by the claims.

What is claimed is:

1. A method of installing a retractable thermocouple for sensing a flame of a flare pilot at an upper end of a flare stack, said method comprising the steps of:

(a) pushing said retractable thermocouple through a first set of offset straightening rollers to straighten said retractable thermocouple in a first plane; then (b) pushing said retractable thermocouple through a second set of offset straightening rollers to straighten said retractable thermocouple in a second plane different from said first plane; and then (c) pushing said retractable thermocouple through a conduit which extends upwardly toward said flare pilot at said upper end of said flare stack, wherein each of said straightening rollers in said first set and said second set of said offset straightening rollers has a non-metallic contacting surface which contacts said retractable thermocouple.

2. The method of claim 1 wherein said retractable thermocouple is pushed through said first set of said offset straightening rollers in accordance with step (a), said second set of said offset straightening rollers in accordance with step (b), and said conduit in accordance with step (c) using a set of drive wheels having non-metallic contacting surfaces which contact said retractable thermocouple.

3. The method of claim 2 wherein said first set and said second set of said offset straightening rollers each individually comprise:

a first idler roller which is positioned on a first lateral side of and is in contact with said retractable thermocouple;

a second idler roller which is also positioned on said first lateral side of and is in contact with said retractable thermocouple, said second idler roller being located downstream of said first idler roller in a direction of travel of said retractable thermocouple; and an adjustable deflecting roller which is positioned between said first and said second idler rollers in said direction of travel and is located on a second lateral side of said retractable thermocouple opposite said first lateral side, said adjustable deflecting roller being adjustably moveable toward and away from said retractable thermocouple, wherein said adjustable deflecting roller is set in contact with said retractable thermocouple such that said adjustable deflecting roller deflects said retractable thermocouple toward said first lateral side as said retractable thermocouple travels from said first idler roller to said second idler roller.

4. The method of claim 3 wherein a centerline of said retractable thermocouple is deflected by said adjustable deflecting roller toward said first lateral side by an amount in a range of from about ⅛ to about ¾ of an inch.

5. The method of claim 4 wherein said centerline of said retractable thermocouple is deflected by said adjustable deflecting roller toward said first lateral side by an amount in a range of from about ¼ to about ½ of an inch.

6. The method of claim 3 wherein said first set and said second set of said offset straightening rollers each individually further comprises an adjustable exit angle roller which is positioned downstream of said second idler roller in said direction of travel and is located on said second lateral side of said retractable thermocouple, said adjustable exit angle roller being adjustably moveable toward and away from said retractable thermocouple and said adjustable exit angle roller being set in contact with said retractable thermocouple such that said adjustable exit angle roller deflects said retractable thermocouple toward said first lateral side.

7. The method of claim 6 wherein said first idler roller, said second idler roller, said adjustable deflecting roller, and said adjustable exit angle roller are each formed of urethane.

8. The method of claim 7 wherein said urethane is 95A urethane.

9. The method of claim 2 wherein said set of drive wheels comprises a first pair of opposing drive wheels and a second pair of opposing drive wheels, said retractable thermocouple being positioned between said first pair of opposing drive wheels and between said second pair of opposing drive wheels such that each of said first pair and second pair of opposing drive wheels applies a shear force to said retractable thermocouple which pushes said retractable thermocouple through said first set of said offset straightening rollers, said second set of said offset straightening rollers, and said conduit.

10. The method of claim 9 further comprising the step of turning said first pair and said second pair of opposing drive wheels using a power tool.

11. The method of claim 10 wherein said power tool rotates a drive gear which turns said first pair and said second pair of opposing drive wheels and wherein said power tool is operably linked to said drive gear by a gear box and a chuck adaptor.

12. The method of claim 11 wherein said power tool is an electric or pneumatic drill.

13. The method of claim 9 wherein each of said drive wheels is formed of urethane.

14. The method of claim 13 wherein said urethane is 93A urethane.

15. The method of claim 2 further comprising the step of guiding said retractable thermocouple into said set of drive wheels by receiving said retractable thermocouple through a non-metallic guide.

16. The method of claim 15 wherein said non-metallic guide is formed of urethane.

17. The method of claim 2 wherein:

said set of drive wheels and said first set and said second set of offset straightening rollers are secured on a portable mounting structure and said method further comprises the step of removably securing said portable mounting structure at a lower end portion of said flare stack.

18. The method of claim 2 wherein:

said set of drive wheels and said first set and said second set of said straightening rollers are secured on a portable mounting structure and said method further comprises the step of removably securing said portable mounting structure outside of an enclosure or fence for said flare stack.

* * * * *